United States Patent [19]

Fielder, Jr.

[11] 3,943,598

[45] Mar. 16, 1976

[54] ARM CONSTRUCTION FOR DRAPERY MASTER SLIDE

[75] Inventor: William Van Buren Fielder, Jr., Westminster, Md.

[73] Assignee: Roper Corporation, Kankakee, Ill.

[22] Filed: Sept. 16, 1974

[21] Appl. No.: 506,743

[52] U.S. Cl. ..... 16/93 D; 16/94 R; 16/95 D

[51] Int. Cl.[2] ..... A47H 15/00

[58] Field of Search.. 16/93 D, 94 D, 95 D, 95 DW, 16/96 D

[56] References Cited

UNITED STATES PATENTS

| | | | |
|---|---|---|---|
| 2,709,831 | 6/1955 | Mountain | 16/93 D |
| 2,872,696 | 2/1959 | Perlmutter | 16/93 D |
| 2,930,072 | 3/1960 | Light | 16/93 D |
| 3,609,795 | 10/1971 | Znamirowski | 16/93 D |
| 3,736,620 | 6/1973 | Williamson | 16/96 D |

*Primary Examiner*—George H. Krizmanich
*Attorney, Agent, or Firm*—Wolfe, Hubbard, Leydig, Voit & Osann, Ltd.

[57] ABSTRACT

A master slide for supporting the leading edge portion of a drape which includes a horizontally extending arm having vertical holes for receiving in upright position a forwardly projecting drapery hook at the front and a laterally projecting drapery hook at the tip. Special abutments are provided at the tip to hold the hook positively in its laterally extending direction free of swiveling action so that the leading edge portion of the drape, hooked in stretched condition on the hooks, closely conforms to the front surface of the arm and extends to a point beyond the tip. In the preferred embodiment, the special tip construction is used in both right hand and left hand master slides, forming an overlapping set, with the conformation of the drapes to the arms serving to hold the leading edge portions of the drapes under positive control to preclude any rubbing of the drapery material as the slides move in and out of their overlapping relation. The arm construction is symmetrical about a horizontal plane so that the device is equally effective with the arm projecting to the left or to the right.

5 Claims, 5 Drawing Figures

ARM CONSTRUCTION FOR DRAPERY MASTER SLIDE

It has been common for many years to support the leading edge portion of a pair of drapes upon master slides which overlap when the drapes are pulled to closed position. However, conventional master slides have been constructed in such a way that the leading edge portions are not kept under precise control so that rubbing of the fabric may occur in the region of overlap. Indeed, it is possible in many designs for the front surface of one drapery section to be scraped by the hooks which support the other section as the sections move in overlapping relation, so that the drapery fabric, particularly where formed of glass fiber, quickly suffers irreparable damage.

Moreover, conventional drapery master slides are constructed to bear the weight of the hooks but with little consideration being given to holding the hooks upright free of swiveling action so that the result is a "floppy" look, with the tips of the slides being visible and unsightly.

It is, accordingly, an object of the present invention to provide an improved supporting arm construction in which a first hook is held upright in a forwardly projecting direction and in which means are provided at the tip of the arm for holding a second hook upright, and free of swiveling action, in a laterally projecting direction at substantially right angles to the first, so that when the leading edge portion of a drape is hooked in stretched condition on the hooks, it closely conforms to the front surface of the arm to a position extending beyond the tip of the arm to provide a neat tailored appearance and to preclude any rubbing of the fabric when the slides are used in overlapping pairs.

It is another object of the present invention to provide an arm construction for a drapery master slide which is highly versatile, which may be used with a wide range of drapery materials, and which includes a reversibility feature being equally effective regardless of whether the supporting arm extends to the left or to the right.

It is, generally stated, an object of the present invention to provide a drapery master slide which not only possesses the above features but which is of neat and economical construction, which simplifies the work of the drapery installer and which, once the drapery has been installed, operates without attention or adjustment over a long period of time while presenting an attractive and tailored appearance and which protects the drapery material against any wear due to repeated opening and closing.

Other objects and advantages of the invention will become apparent upon reading the attached detailed description and upon reference to the drawing in which.

Figures 1, 2, 3, 4, 5:
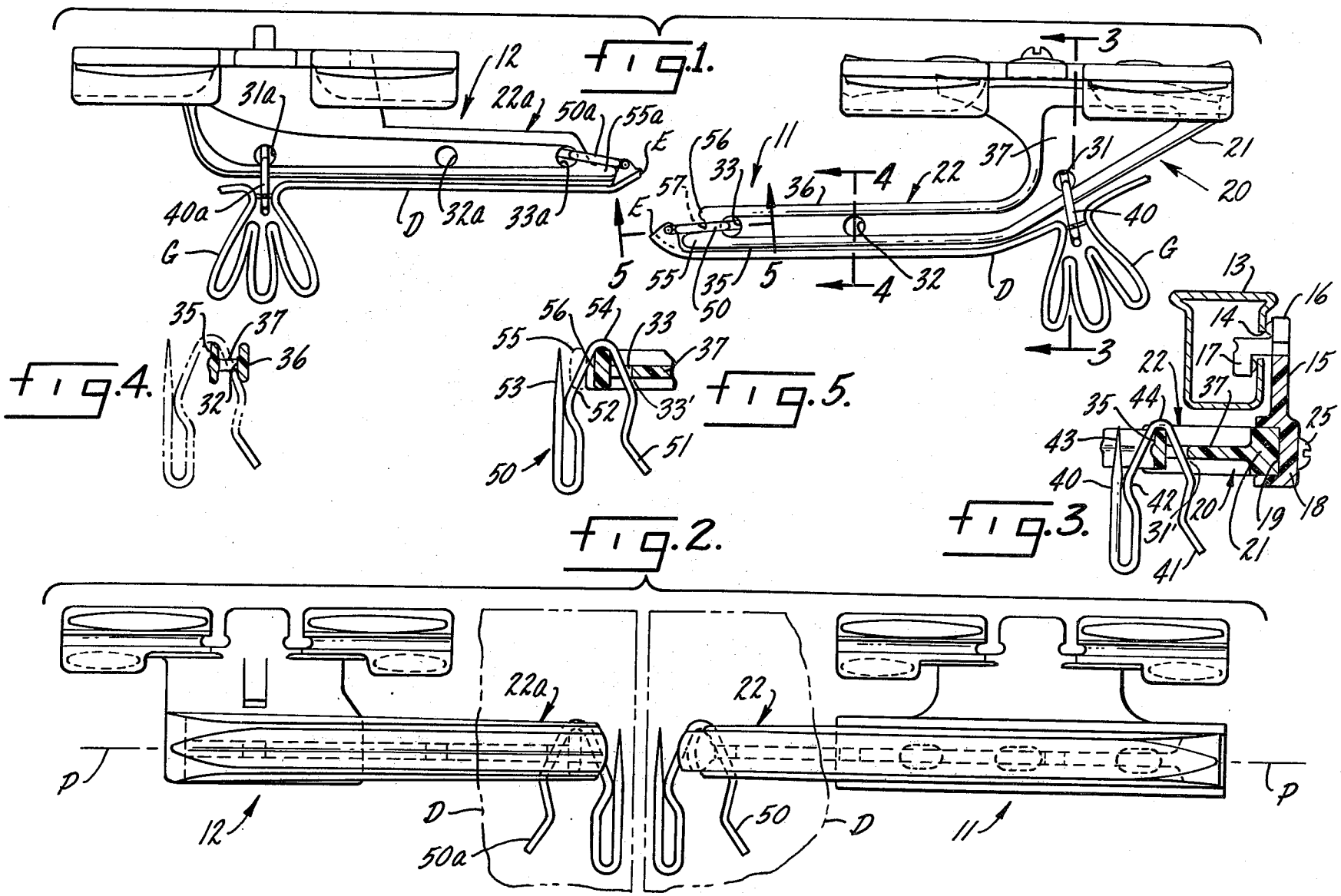
FIG. 1 is a top view of a pair of cooperating drapery master slides employing the present invention and with the leading edge portion of respective drapery sections shown in cross section.
FIG. 2 is a front view corresponding to FIG. 1 but with the leading edges of the drapery sections indicated in phantom only.
FIG. 3 is a fragmentary section taken along line 3—3 in FIG. 1 and showing the drapery rod in cross section but omitting the drapery material.
FIG. 4 is a fragmentary section taken along line 4—4 in FIG. 1.
FIG. 5 is a fragmentary section taken along line 5—5 in FIG. 1.

While the invention has been described in connection with a preferred embodiment, it will be understood that I do not intend to be limited by such embodiment but intend, on the contrary, to cover the various alternative and equivalent forms of the invention included within the spirit and scope of the appended claims.

Turning now to the drawing, there is shown in FIG. 1 a master slide assembly including a right-hand master slide 11 and a left-hand master slide 12. It will be understood that the master slides are intended to cooperate with one another carrying, cantilever fashion, the leading edge portions of a set of drapes for closing in overlapped relation. The right and left hand slides are supported upon a slotted rod 13 which is shown in cross section in FIG. 3, with the horizontal slot at the rear of the rod being indicated at 14. Turning attention to the right hand master slide 11, it includes a slide body 15 having runners 16, 17 which cooperate with lands on each side of the slot 14 so as to support the body in upright position. Along the lower edge of the slide body is a depending horizontally extending skirt 18 which hangs below rod level and which has a face 19.

Mounted upon the skirt 18 and extending forwardly below rod level is a bracket 20 having a base portion 21 and a horizontally extending supporting arm 22. The base 21 of the bracket 20 is secured to the skirt 18 by means of a screw 25. Preferably the skirt and bracket are formed with a series of mating scallops which are dimensioned to permit register of the bracket in a selected one of a plurality of horizontal positions and with the bracket rockingly adjustable in the skirt so that the arm 22 may be rocked slightly in or out to vary the amount of clearance between the right and left hand slides when they are moved into their overlapping relation. For further details of this aspect of the construction, reference may be made to Znamirowski and Fielder U.S. Pat. No. 3,895,410 which issued July 22, 1975.

For the purpose of supporting drapery hooks in upright position the bracket 20, formed of base 21 and arm 22, is formed with a plurality of vertical holes or openings 31, 32, 33, with the hole 33 being positioned adjacent the tip of the arm. The arm 22, as shown in FIG. 4, is preferably of I beam cross section having a front portion or surface 35, a back portion or surface 36, and a central web 37.

A conventional drapery hook 40 of inverted "U"-shape is shown hooked into the vertical opening 31. Such hook has a rear leg 41, front leg 42 and upwardly projecting tip 43. The weight is supported at a bend 44 between the front and rear legs. As shown in FIG. 3, the bend 44 in the hook is supported on the front portion 35 of the arm while the rear leg 41 of the hook reacts against the web 37 at the edge 31' (FIG. 3) of the hole 31, acting as an abutment, to support the hook in upright position and with the rear leg being sufficiently confined so that the hook is substantially prevented from swiveling either to right or left. A hook 50 is similarly inserted in the opening 33 at the tip of the arm, having a rear leg 51, front leg 52, tip 53 and bend 54. The hook 50 is kept upright and kept from rocking in a vertical plane by the abutment 33' (FIG. 5) at the rear edge of the hole 33 which engages the rear leg 51 of the hook. If desired, a hook, shown in phantom in FIG. 4, may be inserted in the center opening 32, but such third hook will usually be found to be unnecessary except where extremely heavy fabrics must be supported.

In accordance with the present invention, the front surface 35 of the arm is extended beyond the hole 33 at the tip sufficiently to form a recess for receiving the front leg 52 of the drapery hook 50 to prevent the hook from swiveling forwardly about a vertical axis and for holding it in a position in which it projects laterally from the tip of the arm. Thus, referring to FIGS. 1 and 5, the front surface 35 is extended to form an auxiliary abutment 55 having an adjacent recess. The auxiliary abutment 55 is in the path of forward swiveling movement of the hook so that the hook cannot swivel forwardly in response to the horizontal pull of the leading edge of the drapery. On the contrary the hook is positively braced in its laterally projecting position with the leading edge of the drapery maintained in neat horizontally "stretched" condition between the hooks 40, 50. In accordance with a preferred embodiment of the invention, the rear surface 36 of the arm is also extended as indicated at 56 so that the front leg of the hook is held against swiveling rearwardly as well as forwardly. Thus, at the same time as the hook 50 is held in upright position by engagement of the rear leg 51 against the abutment 33′ on central web 37 as shown in FIG. 5, the extensions 55, 56 of the surfaces 35, 36 of the arm define between them a recess in the form of a vertically extending groove 57 which holds the front leg 52 of the hook captive against swiveling in either direction from its position laterally extending, with the hook extending beyond the tip of the arm in a direction substantially at right angles to the first mentioned hook 40 which projects forwardly from the bracket structure.

In use, the leading edge portion of a drapery D, which may have a "gathered" or "pleated" portion G and leading edge E, is hooked in stretched condition upon the hooks 40, 50 so that the drapery header is held upright and in a position closely conforming to the front surface of the arm, extending beyond the tip of the arm, so that the tip of the arm and the hook 50 which it carries are completely hidden. The hooks 40, 50, it will be understood, will be usually hooked into the drapery fabric at appropriate spacing to achieve the stretched condition before the rear legs of the hooks are inserted in the respective holes in the slide bracket.

The advantage of this construction may be more fully appreciated by the consideration of the left hand slide 12 shown in FIGS. 1 and 2, and in which corresponding elements have been given corresponding reference numerals with addition of subscript *a*. Thus, a section of drapery D is secured to the arm 22*a* of the master slide by means of a first forwardly projecting hook 40*a* and a second laterally projecting hook 50*a*, the latter hook being prevented from swinging forwardly by reason of the abutment 55*a* which forms an extension of the front surface of the arm. Thus, the drapery D closely follows, and conforms to, the front surface of the arm, free of any forward bagging so that when the master slides 11 and 12 move into their closed, overlapping relation, there is no rubbing or abrasion between the left hand section of the drapery fabric and either the right hand arm or by the hooks which are supported by such arm. Indeed, since the hook 50 on the arm 11 projects laterally and lies in a plane which is parallel to the fabric carried by the opposing arm, the rear leg of the hook 50 is completely shielded and cannot scratch, rub against or otherwise injure the face of the fabric on the left hand slide.

Thus, the construction is to be contrasted with master slides in which all of the hooks engage the arm in front-to-back orientation and in which the rear legs of the hooks project rearwardly a sufficient amount as to come dangerously close to the relatively movable face of the fabric on the left hand slide. Fabrics made of glass fibers have been found to be particularly vulnerable to such scraping or rubbing action, from which it follows that the present slide construction is ideally suited for use with fabrics having a glass fiber content.

While in the preferred embodiment of the invention, both the front and back surfaces of the arm are extended to provide abutments to prevent swiveling of the hook 50 in either direction, it will be understood that the rear abutment 56 may be omitted if desired, reliance being placed upon the force exerted by the drapery fabric to hold the hook 50 against rearward swinging movement. Thus, in the case of the left hand slide, there is only a single "front" abutment 55*a*, the "rear" abutment having been omitted for the sake of simplicity and since slight rearward swing of the hook 50*a*, in the case of the left hand slide 12, is not particularly objectionable.

While it has been mentioned that an additional hook (FIG. 2) may be optionally inserted in the opening 32 for support purposes, it is one of the features of the present cantilevered length, is free of any hook projecting in the front-to-back direction, and the only hook cantilevered on the arm is the hook 50 which is arranged laterally and in a plane which is parallel to the face of the cooperating drapery section. In other words, the face of the left hand drapery, in addition to being kept taut and under control and well clear of the arm 22, is completely free of any hazard from the presented rear leg of a supporting hook.

It will be apparent, then, that the present drapery slide construction not only provides an improved tailored appearance, with the arm of the slide being completely invisible, but it also provides a high degree of inherent protection against rubbing or abrasion of the drapery fabric upon repeated closure of the slides and repeated opening from the overlapped condition.

It is a further feature of the invention that the arm 22 of the right hand slide and the abutments 55, 56 thereon, are symmetrical above and below a horizontal plane P (FIG. 2) so that the hook 50 at the tip of the arm is effectively confined by the abutments regardless of whether the arm is oriented to project to the left, as shown in FIG. 1, or to the right. Where is is desired to project the arm 22 toward the right for engagement, say, with a wall on the right hand side of the opening covered by the drapery, it is a simple matter to loosen the screw 25 which permits removal of the bracket 20 from the skirt 18. The bracket is then rotated 180° so that the arm 22 thereof projects to the right, whereupon the screw 25 may be tightened to fasten the parts together in the new position.

The present construction of drapery slide has been found to be economically moldable in a durable plastic, with all of the disclosed abutting surfaces being integrally formed, and with a high degree of strength per unit weight being achieved by the channeled "I beam" construction, permitting drapery materials having a wide range of type and weight to be accommodated and reliably supported.

It will be apparent that the body 15 of the slide and its bracket 20 may be integrally molded if the reversibility feature is not required. The hole 31 may be formed in the supporting arm 22 or in the base 21 of the bracket, but it is preferably near the junction between the two, which can be considered either base or arm.

I claim:

1. In a master slide for use on a slotted drapery rod and for use with drapery hooks of inverted U-shape having a front leg and a rear leg, the combination comprising a slide body having means for registering with the slot in a rod and for holding the body in upright position on the rod, a bracket having a base portion and supporting arm, the bracket being secured to the slide body with the arm projecting horizontally, the bracket having a vertically extending first hole spaced substantially inwardly from the tip of the arm for receiving the rear leg of a first drapery hook, abutment means on the bracket in the path of vertical swinging movement of one of the legs of a hook for maintaining the first hook upright in a forwardly projecting direction, the arm having a vertically extending second hole in its tip for receiving the rear leg of a second drapery hook with such hook in laterally extending position, abutment means on the tip of the arm in the path of vertical swinging movement of one of the legs of the second drapery hook for maintaining the second hook upright, and an auxiliary abutment at the tip of the arm in the path of forward swiveling movement of the second hook so that the second hook is positively held in a position projecting laterally from the tip at substantially right angles to the first hook and so that when the leading edge portion of a drape is hooked in stretched condition between the hooks it closely conforms to the front surface of the arm to a point extending beyond the tip of the arm.

2. The combination as claimed in claim 1 in which the bracket is separable from the slide body and in which there is provision for reversing the bracket on the body between a leftward extending position and a rightward extending position, the abutment means on the tip of the arm being symmetrical on each side of a horizontal plane so that a hook inserted in the hole at the tip of the arm is held in its laterally extending, drapery-stretching position regardless of whether the arm is directed to the left or to the right and regardless of which direction the hook is inserted into the hole.

3. In a master slide for use on a slotted drapery rod and for use with drapery hooks of inverted U-shape having a front leg and a rear leg, the combination comprising a slide body having means for registering with the slot in the rod and for holding the body in upright position on the rod, a bracket having a base portion and supporting arm, the bracket being secured to the slide body with the arm projecting horizontally, the bracket having a first vertically extending hole spaced substantially inwardly from the tip of the arm for receiving the rear leg of a first drapery hook and for supporting the hook upright in a forwardly projecting direction, the arm having a second vertically extending hole in its tip for receiving the rear leg of a second drapery hook, the front and back surfaces of the arm being extended beyond the hole at the tip thereof to define between them a vertical groove, the groove being spaced from the hole sufficiently to registeringly receive the front leg of the second drapery hook, thereby to hold the second drapery hook captively in a laterally extending direction generally at right angles to the first hook and to prevent such second hook from swiveling movement in either direction with respect to the second hole, so that when the leading edge portion of a drape is hooked in stretched condition on the hooks it closely conforms to the front surface of the arm to a point extending beyond the tip of the arm.

4. The combination as claimed in claim 1, the first hole in the bracket being formed in the base portion thereof clear of the arm so that the arm is free of any front-to-back extending hook, the rear leg of which might jeopardize the overlapped drapery fabric carried in a cooperating slide.

5. A master slide installation for use on a slotted drapery rod and for use with drapery hooks of inverted U-shape having a front leg and a rear leg, the combination comprising cooperating left and right hand slides, each slide having a slide body with means for registering with the slot in a rod for holding the body in upright position on the rod, each slide having a bracket having a base portion and supporting arm, each bracket being secured to the respective slide body so that the arms extend toward one another but spaced front-to-back in overlapping relation, each arm having at least one vertically extending hole in its base portion for receiving the rear leg of a first drapery hook, means on each bracket for maintaining the first hook upright in a forwardly projecting direction, each arm having a vertically extending hole in its tip for receiving the rear leg of a second drapery hook, an auxiliary abutment on the tip of each arm in the path of swiveling movement of the respective hooks for maintaining each second drapery hook upright in a position in which it projects laterally from the tip at substantially right angles to the associated first drapery hook so that when the leading edge portions of respective drapes are hooked in stretched condition between the first and second hooks they closely conform to the front edges of the respective arms to a point extending beyond the tips of the arms, thereby precluding rubbing of the drapery fabric on the rear arm by the backside of the front arm when the slides are moved into closed overlapping relation.

* * * * *